US009031447B2

(12) United States Patent
Tanaka et al.

(10) Patent No.: US 9,031,447 B2
(45) Date of Patent: May 12, 2015

(54) IMAGE HEATING APPARATUS

(71) Applicant: Canon Kabushiki Kaisha, Tokyo (JP)

(72) Inventors: Makoto Tanaka, Kashiwa (JP); Takatoshi Chiba, Kashiwa (JP); Masahiro Takahashi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/044,337

(22) Filed: Oct. 2, 2013

(65) Prior Publication Data

US 2014/0105634 A1 Apr. 17, 2014

(30) Foreign Application Priority Data

Oct. 17, 2012 (JP) ..... 2012-229908

(51) Int. Cl.
*G03G 15/00* (2006.01)
*G03G 15/20* (2006.01)

(52) U.S. Cl.
CPC ..... *G03G 15/2053* (2013.01); *G03G 15/2042* (2013.01); *G03G 2215/2035* (2013.01)

(58) Field of Classification Search
USPC ..... 399/90, 328, 329
See application file for complete search history.

(56) References Cited

U.S. PATENT DOCUMENTS

| | | | | |
|---|---|---|---|---|
| 6,665,504 | B2 * | 12/2003 | Lee et al. | 399/90 |
| 7,130,572 | B2 * | 10/2006 | Kubochi et al. | 399/329 |
| 7,340,207 | B2 * | 3/2008 | Cho et al. | 399/328 |
| 7,480,480 | B2 | 1/2009 | Endo et al. | |
| 7,486,899 | B2 * | 2/2009 | Choi et al. | 399/33 |
| 7,505,725 | B2 | 3/2009 | Katayama et al. | |
| 7,546,078 | B2 | 6/2009 | Okuda et al. | |
| 8,095,058 | B2 | 1/2012 | Chiba | |
| 8,380,100 | B2 * | 2/2013 | Sohn | 399/90 |
| 8,577,269 | B2 | 11/2013 | Takahashi | |
| 8,644,749 | B2 * | 2/2014 | Choi et al. | 399/330 |
| 8,649,699 | B2 * | 2/2014 | Kajita | 399/90 |
| 8,779,335 | B2 * | 7/2014 | Saito | 219/469 |
| 2002/0164176 | A1 * | 11/2002 | Lee | 399/90 |
| 2006/0013611 | A1 * | 1/2006 | Ise | 399/90 |
| 2009/0074440 | A1 * | 3/2009 | Nanno et al. | 399/67 |
| 2010/0232825 | A1 * | 9/2010 | Kakitani | 399/90 |
| 2012/0051806 | A1 | 3/2012 | Takahashi | |
| 2012/0251138 | A1 * | 10/2012 | Ishida et al. | 399/33 |
| 2013/0051875 | A1 | 2/2013 | Takahashi | |
| 2013/0108306 | A1 * | 5/2013 | Saito et al. | 399/90 |
| 2013/0202334 | A1 | 8/2013 | Takahashi | |
| 2013/0302060 | A1 * | 11/2013 | Moriya et al. | 399/90 |
| 2013/0319825 | A1 | 12/2013 | Takahashi | |
| 2013/0330103 | A1 | 12/2013 | Takahashi | |
| 2014/0086612 | A1 * | 3/2014 | Cheong | 399/90 |
| 2014/0105633 | A1 * | 4/2014 | Takahashi | 399/90 |
| 2014/0161479 | A1 * | 6/2014 | Yoshida et al. | 399/90 |

FOREIGN PATENT DOCUMENTS

| | | | |
|---|---|---|---|
| JP | 2004-214056 | A | 7/2004 |
| JP | 2009-075443 | A | 4/2009 |

* cited by examiner

*Primary Examiner* — Clayton E Laballe
*Assistant Examiner* — Ruifeng Pu
(74) *Attorney, Agent, or Firm* — Fitzpatrick, Cella, Harper & Scinto

(57) ABSTRACT

An image heating apparatus includes a heater for heating an image surface of a recording medium, a plurality of electrodes arrayed at an end of the heater, and a connector including energizing terminals and attached to the end of the heater to energize the electrodes. The connector also includes an engage portion which is engaged with a support member to lock the connector. The connector is configured such that an engage position of the engage portion is located between the energizing terminals located at both ends.

9 Claims, 11 Drawing Sheets

PRESSING CONDITION

PRESSURE-RELEASING CONDITION

IMAGE HEATING APPARATUS

BACKGROUND OF THE INVENTION

1. Field of the Invention

The present invention relates to an image heating apparatus in which a connector is attached to an end of a heating member.

2. Description of the Related Art

Hitherto, Japanese Patent Application Laid-open No. 2004-214056 has disclosed a heating apparatus in which a groove of a U-shaped connector is fitted with a projection of a stay holder to attach the connector to an end of a ceramic heater and the attached connector is locked by a hooked member. Japanese Patent Application Laid-open No. 2009-75443 has disclosed a heating apparatus in which two or three electrodes are disposed at an end of a heater in a rotation axial direction of a fixing belt.

In accordance with a number of increased electrodes disposed at the end of the heater as described in Japanese Patent Application Laid-open No. 2009-75443, a number of energizing terminals of the connector inserted to/pulled out of the end of the heating member also increases, and the connector tends to be enlarged in a direction in which the energizing terminals are arrayed.

While the heating apparatus described in Japanese Patent Application Laid-open No. 2004-214056 locks the connector by the hooked member, a moment that tries to rotate the connector increases when an external force acts on a wiring line of the connector if the connector is enlarged as described above. Then, the large moment acts on the connector even if the force acting on the wiring line of the connector is small, and a force that tries to shift a contact between the energizing terminal and an electrode increases. As a result, the configurations described above have had a problem that they tend to cause friction on a contact surface of the energizing terminal and the electrode and to cause a contact failure.

SUMMARY OF THE INVENTION

According to an aspect of the present invention, an image heating apparatus includes a belt member configured to heat an image on a recording medium, a support member configured to rotatably support a longitudinal end of the belt member and to include a first engage portion, a heating member including a plurality of electrodes arrayed at an longitudinal end thereof and configured to heat the belt member by being energized through the plurality of electrodes and a connector including a plurality of energizing terminals connected respectively to the plurality of electrodes and attached to the longitudinal end of the heating member, and a second engage portion that engages with the first engage portion to lock the connector and the heating member, the second engage portion engaging with the first engage portion such that a center in an array direction in which the electrodes are arrayed of the second engage portion is located between centers in the array direction of first and second end energizing terminals located at both ends among the plurality of energizing terminals.

Further features of the present invention will become apparent from the following description of exemplary embodiments with reference to the attached drawings.

DESCRIPTION OF THE EMBODIMENTS

<Image Forming Apparatus>

Figure 1:
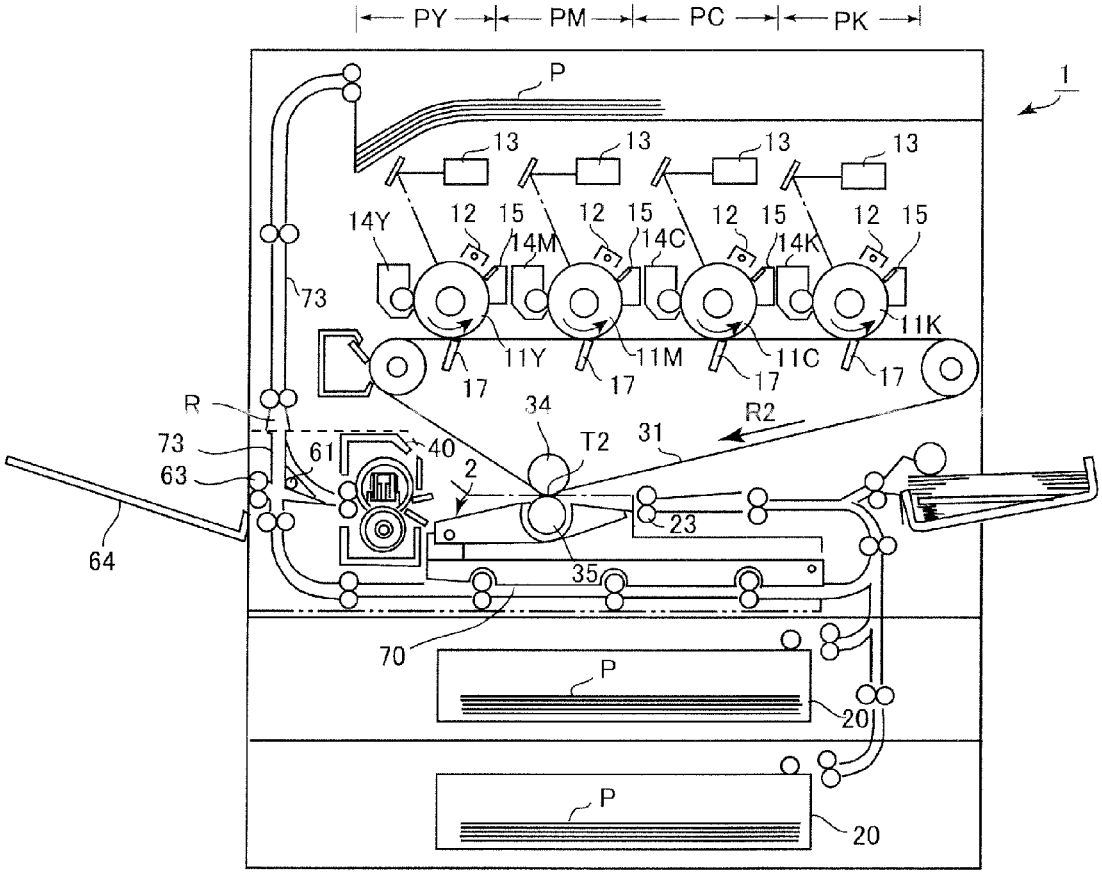
FIG. 1 is a schematic diagram illustrating an entire configuration of an image forming apparatus.

FIG. 1 is a schematic diagram illustrating a configuration of an image forming apparatus of the invention. As shown in FIG. 1, the image forming apparatus 1 is a tandem intermediate transfer-type full-color printer in which yellow, magenta, cyan and black image forming portions PY, PM, PC, and PK are arrayed along an intermediate transfer belt 31.

A yellow toner image is formed on a photoconductive drum 11Y in the image forming portion PY and is transferred to an intermediate transfer belt 31. A magenta toner image is formed in a photoconductive drum 11M in the image forming portion PM and is transferred to the intermediate transfer belt 31. Cyan and black toner images are formed respectively on photoconductive drums 11C and 11K in the image forming portions PC and PK and are transferred sequentially to the intermediate transfer belt 31.

A recording medium P is taken out of a recording medium cassette 20 one by one and stands by at a registration roller 23. Specific examples of the recording medium P include a plain sheet and as substitutes for the plain sheet, a resin sheet, a coated sheet, a thick sheet, an overhead projector sheet, and the like.

The registration roller 23 feeds the recording medium P to a secondary transfer portion T2 timely with the toner images on the intermediate transfer belt 31 to secondarily transfer the toner images from the intermediate transfer belt 31 to the recording medium P. The recording medium P on which the four colors of toner images have been secondarily transferred is then conveyed to a fixing apparatus 40. Then, the recording medium P is heated and pressed by the fixing apparatus 40 such that the toner image is fixed, and is discharged to an outside tray 64 by a discharge roller 63.

In a case of a two-side printing in which toner images are formed on both surfaces of the recording medium P, the recording medium P on which the toner image has been fixed to one surface thereof by the fixing apparatus 40 is guided upward by a flapper 61. The recording medium P is reversed in terms of its front and back surfaces while being conveyed through and switched back in a conveying path 73. Then, the recording medium P is conveyed through a two-side path 70 and stands by again at the registration roller 23. Then, a toner image is formed on also another surface in the secondary transfer portion T2. The fixing apparatus 40 fixes the toner image on the other surface of the recording medium P, and the recording medium P is discharged to the outside tray 64.

The respective image forming portions PY, PM, PC and PK are configured substantially in the same manner except that colors of the toners used in developers 14Y, 14M, 14C and 14K are different as yellow, magenta, cyan and black. Accordingly, only the configuration of the image forming portion PY will be explained below and an overlapped explanation of the image forming portions PM, PC and PK will be omitted.

Disposed around the photoconductive drum 11Y in the image forming portion PY are a corona charger 12, an exposure unit 13, a developer 14, a transfer blade 17, and a drum cleaning unit 15.

The corona charger 12 charges the surface of the photoconductive drum 11Y with a homogeneous potential. The exposure unit 13 draws an electrostatic image of an image to be formed on the photoconductive drum 11Y by scanning a laser beam. The developer 14 develops the electrostatic image and forms a toner image on the photoconductive drum 11Y. By being applied with a voltage, the transfer blade transfers the toner image on the photoconductive drum 11Y to the intermediate transfer belt 31.

<Fixing Apparatus>

Figure 2:
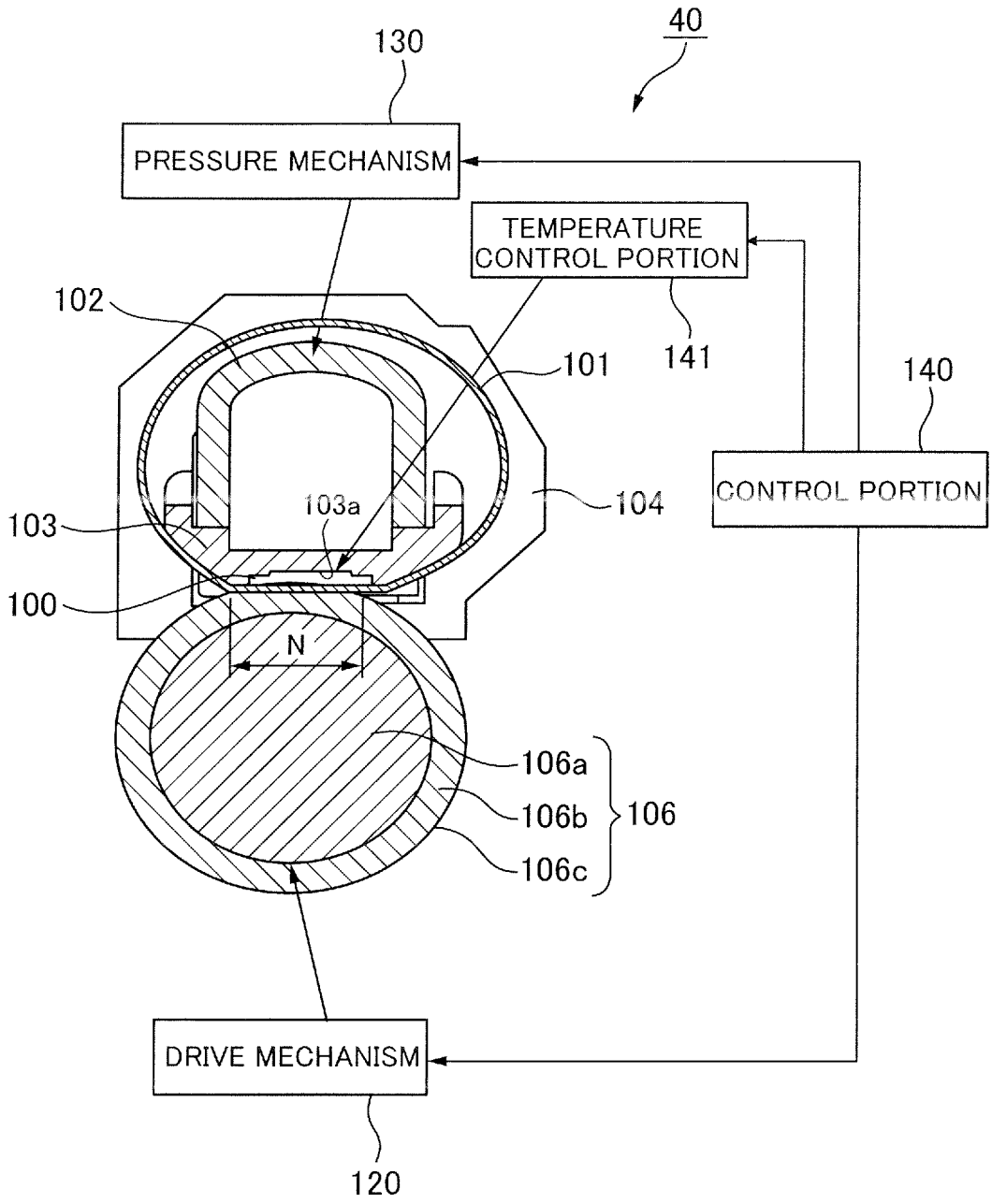
FIG. 2 is a schematic diagram illustrating a configuration of a fixing apparatus.
Figure 3B:
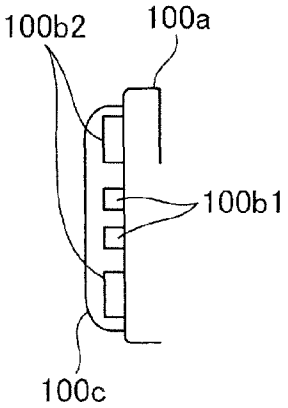
FIG. 3B is a schematic section view of the ceramic heater.
Figure 3A:
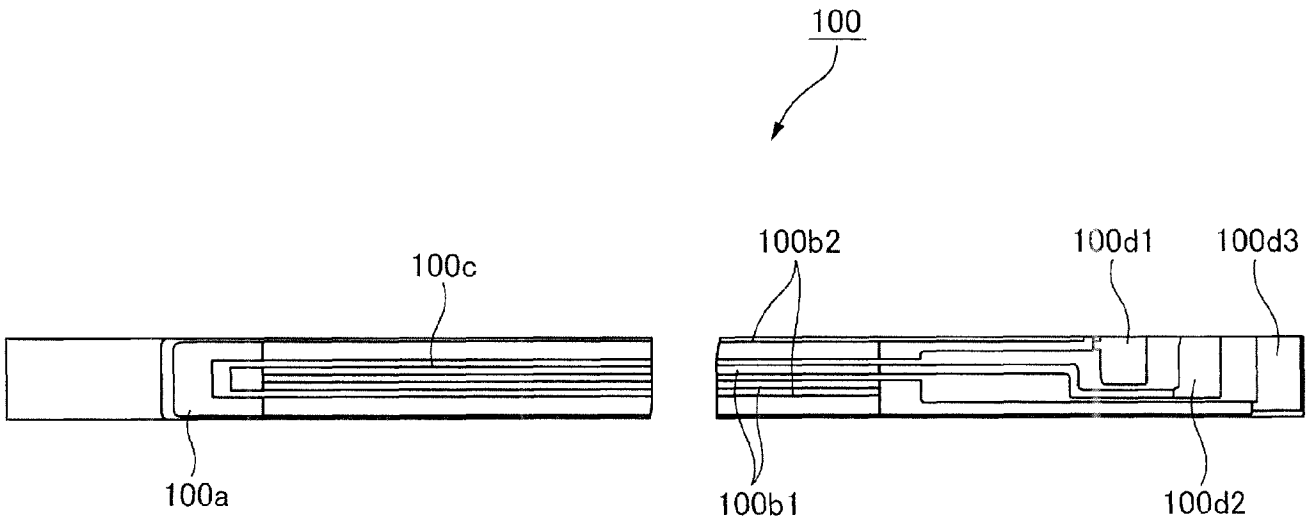
FIG. 3A is a schematic plan view of a ceramic heater.
Figure 4:
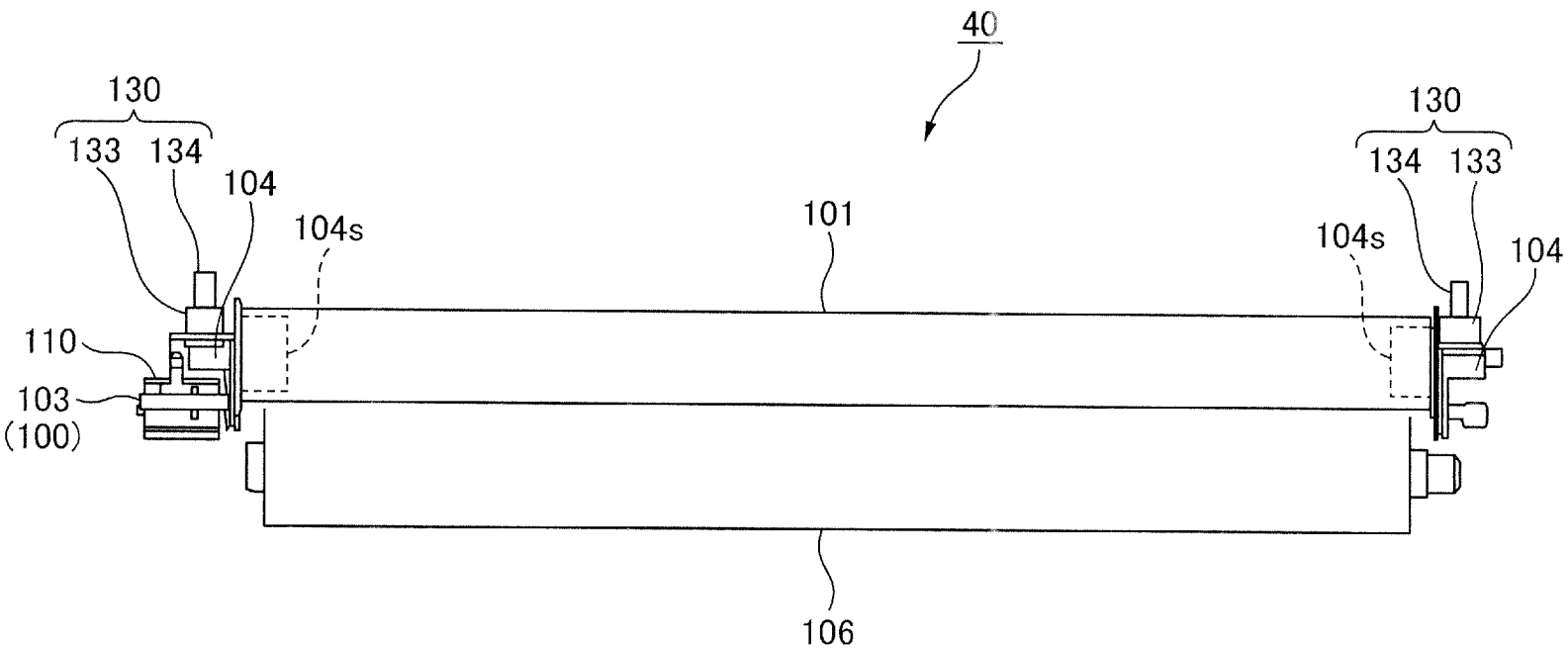
FIG. 4 is a schematic diagram illustrating disposition of fixing flanges.

FIG. 2 is a schematic diagram illustrating a configuration of a fixing apparatus, FIGS. 3A and 3B illustrate a configuration of a ceramic heater, and FIG. 4 illustrates disposition of fixing flanges.

As shown in FIG. 2, a fixing belt 101, i.e., one exemplary belt member, rotates while in contact with an image surface of a recording medium. A fixing flange 104, i.e., one exemplary support member, rotatably supports an longitudinal end of the fixing belt 101. A guide member 103 supports a ceramic heater 100, i.e., one exemplary heating member, and guides the rotation of the fixing belt 101. A pressure roller 106, i.e., one exemplary pressure contact roller, is brought in pressure contact with the ceramic heater 100 through an intermediary of the fixing belt 101 and forms a nip portion N with the fixing belt 101. A pressure mechanism 130 presses the fixing flange 104 toward the pressure roller 106 such that a pressure at the nip portion N can be varied.

The ceramic heater 100, i.e., one exemplary substrate member, is provided with a plurality of electrodes 100*d* arrayed at an longitudinal end of the ceramic heater 100 projecting from the fixing flange 104 in a rotation axial direction, i.e., a longitudinal direction, of the fixing belt 101. The ceramic heater 100 generates heat by being energized through the plurality of electrodes 100*d* and heats the image surface of the recording medium through the intermediary of the fixing belt 101.

The belt heating-type fixing apparatus 40 is configured to form the nip portion N by interposing the fixing belt 101 between the ceramic heater 100 and the pressure roller 106 as described above. The fixing apparatus 40 is configured to lead a recording medium carrying a non-fixed toner image into the nip portion N and to pinch and convey together with the fixing belt 101. Then, the fixing apparatus 40 fixes the non-fixed toner image on the recording medium P by applying pressure of the nip portion N while applying heat of the ceramic heater 100 through the fixing belt 101.

The fixing belt 101 is driven in synchronism with the rotation of the pressure roller 106. The fixing belt 101 is a cylindrical heat resistant belt member, i.e., an exothermic member, that transmits heat to the recording medium P. The fixing belt 101 is loosely fitted around the guide member 103.

The fixing belt 101 is a single-layer endless belt using a fluororesin material such as PTFE, PFA, or FEP of 30.0 mm in outer diameter and 100 μm or less in thickness, or more preferably more than 20 μm and less than 50 μm in thickness. Or, the fixing belt 101 may be a composite layer endless belt in which a fluororesin material such as PTFE, PFA, FEP or the like is coated on an outer circumferential surface of a heat resistant resin material such as polyimide, polyamide imide, PEEK, PES, PPS or the like. It is also possible to adopt a metallic endless belt.

The pressure roller 106 is driven by the drive mechanism 120 and rotates substantially with equal circumferential speed with conveying speed of the recording medium P carrying the toner image and conveyed from the secondary transfer portion T2 (see FIG. 1). An outer diameter of the pressure roller 106 is 25 mm. The pressure roller 106 is composed of a shaft member 106*a* formed by an aluminum cylindrical material of 20 mm in outer diameter and 1.3 mm in thickness, an elastic layer 106*b* made of soft silicon rubber having 64° of Asker hardness and 2.5 mm in thickness and formed around the shaft member 106*a*, and a mold release layer 106*c* made of a PFA tube of 50 μm in thickness and coated on a surface of the elastic layer 106*b*.

Bearing members not shown and made of heat resistant resin such as PEEK, PPS, and liquid crystal polymer are attached to both ends of the shaft member 106*a* and are rotatably held by side plates not shown. It is preferable to use a material which is excellent in mold releasing and heat resistant qualities such as fluororesin, silicone resin, fluorosilicone rubber, fluororubber, silicone rubber, PFA, PTFE and FEP for the mold releasing layer 106*c*.

As shown in FIG. 3, the ceramic heater 100 includes resistance heating elements 100*b*1 and 100*b*2 and increases temperature thereof by heat generated by the resistance heating elements 100*b*1 and 100*b*2 to which electric power is supplied. The ceramic heater 100 includes the resistance heating elements 100*b*1 and 100*b*2 formed by printing and sintering a thick film of Ag.Pd paste on a ceramic substrate ($Al_2O_3$) 100*a*, and a glass protective layer 100*c* concealing a surface of the resistance heating elements.

The resistance heating elements 100*b*1 and 100*b*2 are formed such that their respective distributions of generated heat are different. The resistance heating element 100*b*1, i.e., a main heater, is composed of two lines along a center line of the ceramic heater 100 and is formed such that a cross-sectional are of a resistance heating layer at a longitudinal center part thereof is small and a cross-sectional are of the resistance heating layer at ends thereof is large so that a quantity of heat increases at the center part. The resistance heating element 100*b*2, i.e., a sub-heater, is composed of two lines disposed outside of the resistance heating element 100*b*1 and is formed such that a cross-sectional are of a resistance heating layer at the center part is large and a cross-sectional are of the resistance heating layer at the ends is small so that a quantity of heat increases at the ends. A composite quantity of heat of the quantities of heat of the resistance heating element 100*b*1 and the resistance heating element 100*b*2 is substantially constant along the longitudinal direction of the ceramic heater 100. The electrode 100*d*1 electrically conducts the resistance heating element 100*b*2, and the electrode 100*d*2 electrically conducts the resistance heating element 100*b*1. The electrode 100*d*3 electrically conducts the resistance heating elements 100*b*1 and 100*b*2 in common.

As shown in FIG. 2, the ceramic heater 100 is fitted into and supported by a fitting groove 103*a* formed on an under surface of the guide member 103. That is, the guide member 103 positions and holds the ceramic heater 100. The guide member 103 supports the fixing belt 101, presses the nip portion N formed in pressure contact with the pressure roller 106, and stabilizes conveyance of the fixing belt 101 during when the belt 101 rotates.

The guide member 103 is disposed so as to extend through the inside of the loop formed by the fixing belt 101 in the rotation axial direction and slides against an inner surface of the fixing belt 101. The guide member 103 is formed into a beam-like shape by using a synthetic resin material which is heat resistant, whose coefficient of friction is low and whose thermal conductivity is low. The exemplary synthetic resin materials include phenol resin, polyimide resin, polyamide resin, polyamide-imide resin, PEEK resin, PES resin, PPS resin, PFA resin, PTFE resin, and LCP resin.

The ceramic heater 100 supported by the guide member 103 is biased toward the pressure roller 106 through the intermediary of the fixing belt 101. The ceramic heater 100 and the guide member 103 are biased together toward the pressure roller 106 and forms the nip portion N between the fixing belt 101 and the pressure roller 106.

A stay 102 is disposed inside of the fixing belt 101, supports the entire guide member 103 in the longitudinal direction, and biases the guide member 103 toward the pressure roller 106. The stay 102 assures strength of the guide member 103. The stay 102 is formed into a shape of a beam having a U-shape in section by a steel member. The stay 102 is pressed against a back surface of the guide member 103 which is relatively flexible to enhance longitudinal strength of the guide member 103 and to correct a shape of deflection of the guide member 103.

As shown in FIG. 4, the fixing flange 104 is fitted with and held by a side plate not shown. The fixing flanges 104 are fitted into both ends of the stay 102 such that the fixing flanges 104 guide rotation of the fixing belt 101 and restrict the ends of the fixing belt 101 to stop the fixing belt 101 from falling out.

Because the fixing belt 101 of the fixing apparatus 40 is thin and has a small thermal capacity and favorable thermal responsibility, the fixing belt 101 can have the similar thermal property with the ceramic heater 100 and reflect the thermal change of the ceramic heater to the nip portion N substantially as it is. Accordingly, the fixing belt 101 reaches a fixing temperature in a short time from energization of the ceramic heater 100, realizing power saving in this aspect.

<Pressure Mechanism>

Figure 5A:
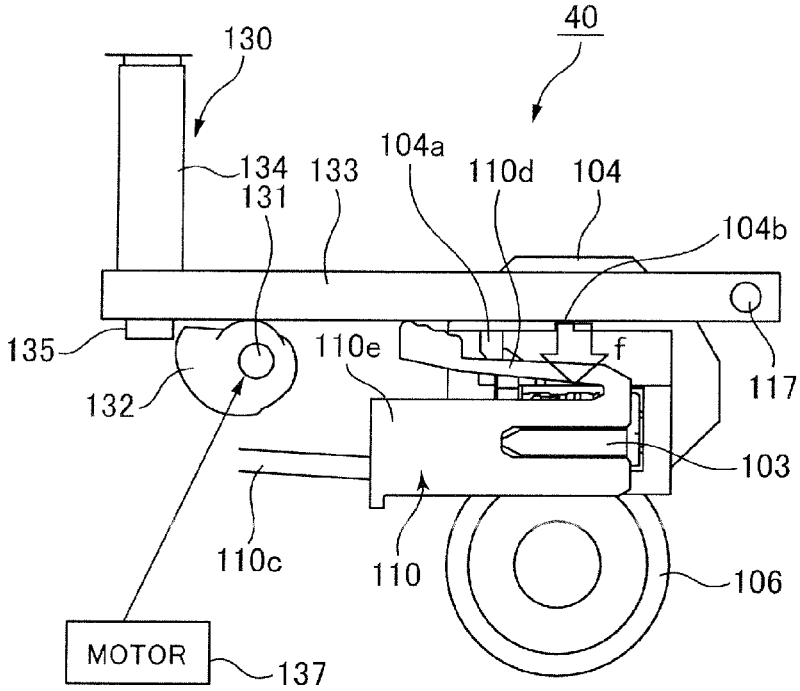
FIG. 5A illustrates a pressure mechanism in a pressing condition.
Figure 5B:
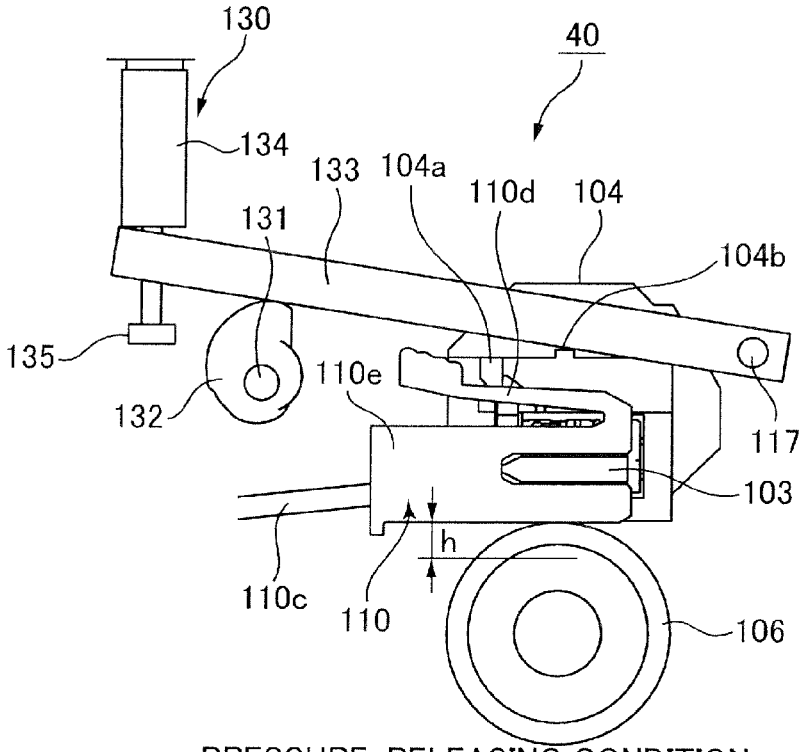
FIG. 5B illustrates the pressure mechanism in a pressure-releasing condition.

FIG. 5A illustrates a pressure mechanism 130 in a pressing condition, and FIG. 5B illustrates the pressure mechanism 130 in a pressure-releasing condition. As shown in FIGS. 4 and 5A, a pair of the same pressure mechanisms 130 is provided respectively corresponding to the fixing flanges 104 on back and front sides of the fixing belt 101. The pressure mechanism 130 presses the fixing belt 101 downward and forms the nip portion for a recording medium between the fixing belt 101 and the pressure roller 106 by releasing a press lever 133 pushed up by an eccentric cam 132. That is, the eccentric cam 132 is rotated such that the press lever 133 moves in a direction pressing a pressed portion 104*b* of the fixing flange 104, so that a pressing condition in which a pressure (f) is applied between the fixing belt 101 and the pressure roller 106 is brought about.

The press lever 133 is rotatable with a support shaft 117 as a fulcrum and presses the pressed portion 104*b* of the fixing flange 104 in a condition in which a rotating end thereof is pressed by a pressure spring-attached screw 134. The pressure spring-attached screw 134 is fixed to the press lever 133 by a pressure spring fixing portion 135. When a drive shaft 131 of the eccentric cam 132 is rotated by a motor 137, the eccentric cam 132 rotates centering on the drive shaft 131 and elevates the rotating end of the press lever 133.

As shown in FIG. 5B, the pressure mechanism 130 also releases the pressure of the fixing belt 101 and separates the fixing belt 101 from the pressure roller 106 by pushing up the press lever 133 by the eccentric cam 132. That is, the eccentric cam 132 is rotated such that the press lever 133 moves in a direction separating from the pressed portion 104*b* of the fixing flange 104, so that the pressure between the fixing belt 101 and the pressure roller 106 is released. The pressure is released for such purposes of easing a force in pulling out a jammed recording medium in handling jamming and of preventing deformation of the fixing belt 101 during when a power is OFF or in a sleep mode.

<Connector>

Figure 6:
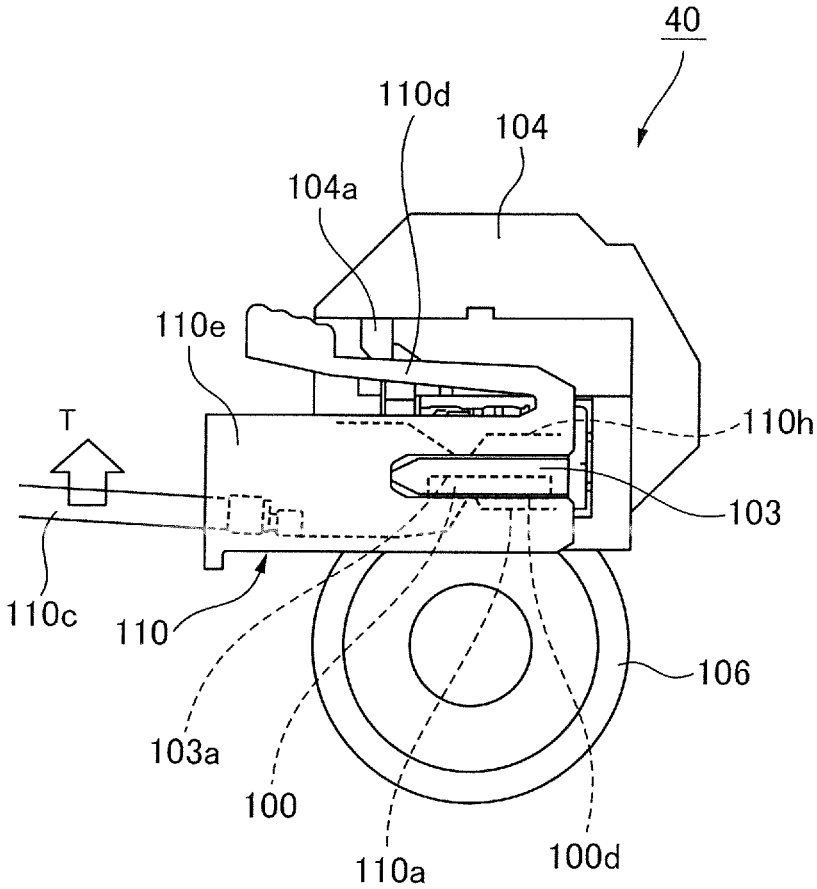
FIG. 6 illustrates a condition in which a connecter is attached.

FIG. 6 shows a condition in which the connecter 110 is attached.

As shown in FIGS. 3A and 3B, the ceramic heater 100 has the plurality of electrodes 100*d* (100*d*1, 100*d*2, and so on) connected to the resistance heating elements 100*b* (100*b*1, 100*b*2, and so on).

As shown in FIG. 6 and with reference to FIG. 4, the connector 110 is removably attached to a part where the ceramic heater 100 and the guide member 103 project out of the fixing flange 104 in the rotation axial direction. The ceramic heater 100 is fitted into and held by the fitting groove 103*a* formed on the under surface of the guide member 103. The U-shaped connector 110 is attached such that it sandwiches the ceramic heater 100 and the guide member 103 overlapped with each other. When the ceramic heater 100 is fitted into the fitting groove 103*a* provided on the under surface of the guide member 103 and the connector 110 is attached, an energizing terminal 110*a* within the connector 110 comes into contact electrically with the electrode 100*d* of the ceramic heater 100. That is, the spring-like energizing terminal 110*a* provided in the connector 110 comes into contact electrically with the electrode 100*d* of the ceramic heater 100 so that power is fed to the ceramic heater 100. A spring member 110*h* within the connector 110 presses the ceramic heater 100 toward the energizing terminal 110*a*.

The plurality of energizing terminals 110*a* (110*a*1, 110*a*2 and so on) provided on the connector 110 is formed into a shape of a spring such that one end thereof is fixed to an inner surface of the connector 110 and such that a contact portion on another end elastically elevates. The energizing terminals 110*a* (100*a*1, 100*a*2, and so on) come into contact respectively with the electrodes 100*d* (100*d*1, 100*d*2 and so on) of the ceramic heater 100 and feed power to the resistance heating elements 100*b* (100*b*1, 100*b*2, and so on).

The energizing terminal 110*a* is molded by using a resilient metallic material. The fixed end of the energizing terminal 110*a* is connected with a wiring line 110*c* within a housing member 110*e* of the connector 110. This wiring line 110*c* of the connector 110 extends in an intersection direction intersecting with the rotation axial direction described above. The housing member 110*e* of the connector 110 is composed of a resin material such as LCP having excellent insulating and heat-resisting properties, and holds the energizing terminal 110*a*.

A connector locking structure is provided between the connector 110 and the fixing flange 104. That is, a connector stopping lock portion 110*d* is disposed on a back surface of the connector 110. The lock portion 110*d* is a hook arm whose one end is fixed to an upper surface (back surface) of the connector 110 and which moves elastically up and down. The fixing flange 104 has an interlock portion 104*a* that locks the lock portion 110*d* of the connector 110. The interlock portion 104*a* is formed integrally with the fixing flange 104 at position corresponding to the lock portion 110*d*. The interlock portion 104*a* projects in the rotation axial direction of the fixing belt 101 from a side surface of the fixing flange 104.

A move of the connector 110 with respect to the energizing electrode 100*d* is limited when the lock portion 110*d* of the connector 110 is locked by the interlock portion 104*a* of the fixing flange 104. That is, even if the connector 110 is pulled due to resilience of a bundle of lines and to the pressing/pressure-releasing motion of the fixing belt 101 and the pressure roller 106, the lock portion 110*d* limits the move of the connector 110 with respect to the electrode 100*d*.

FIRST COMPARATIVE EXAMPLE

Figure 7A:
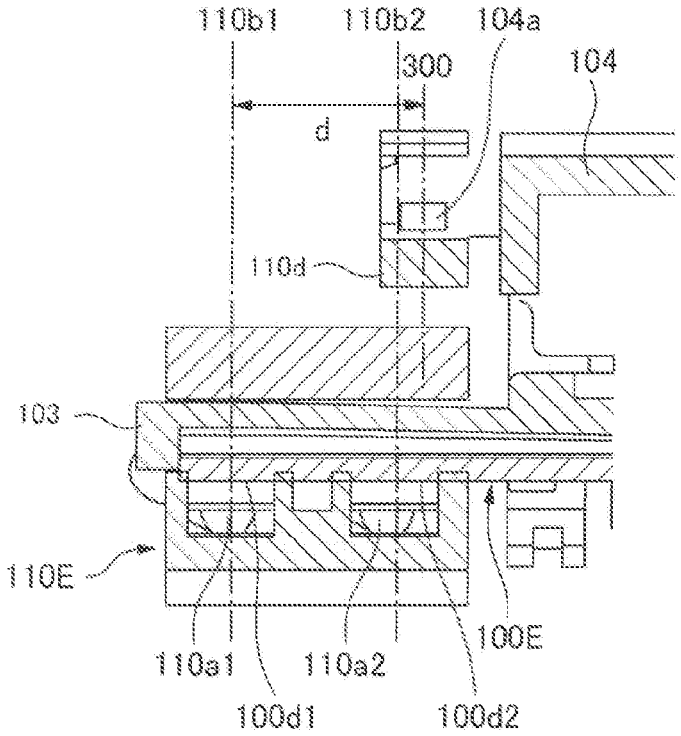
FIG. 7A is a vertical section view showing a connector locking structure of a first comparative example.
Figure 7B:
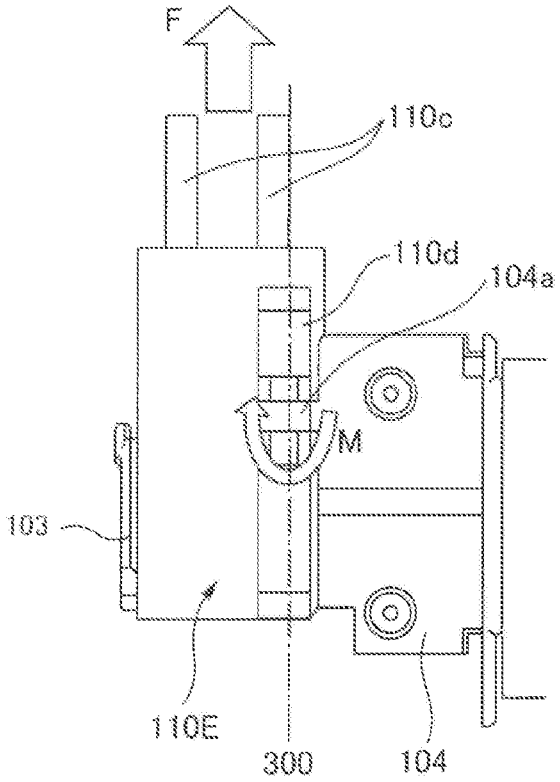
FIG. 7B is a plan view showing the connector locking structure of a first comparative example.

FIG. 7 illustrates the connector locking structure of a first comparative example. FIG. 7A is a vertical section view in parallel with the rotation axial direction of the comparative example in an assembled condition, and FIG. 7B is a plan view of the connector locking structure in the assembled condition. While structures and sizes of the respective components of the first comparative example are the same with those of the fixing apparatus 40 described above, the ceramic heater 100 in FIG. 6 will be denoted as a ceramic heater 100E and the connector 110 as a connector 110E in the first comparative example in order to distinguish the first comparative example from embodiments described later.

As shown in FIG. 7A, the ceramic heater 100E disposed on the under surface of the guide member 103 has two electrodes 100*d*1 and 100*d*2 in the first comparative example. The U-shaped connector 110E is attached such that it sandwiches the ceramic heater 100E and the guide member 103 overlapped with each other. The energizing terminals 110*a*1 and 110*a*2 provided on the connector 110E come into contact with the electrodes 100*d*1 and 100*d*2 of the ceramic heater 100E, respectively.

As shown in FIG. 7B, the connector stopping lock portion 110*d* is disposed on the upper surface of the connector 110E. In the first comparative example, a center line 300 of the lock portion 110*d* is disposed on a side closer to the fixing flange 104 than a center line 110*b*2 of the energizing terminal 110*a*2 located on the side closer to the fixing flange 104 among the energizing terminals 110*a*1 and 110*a*2 of the connector 110E.

SECOND COMPARATIVE EXAMPLE

Figure 8A:
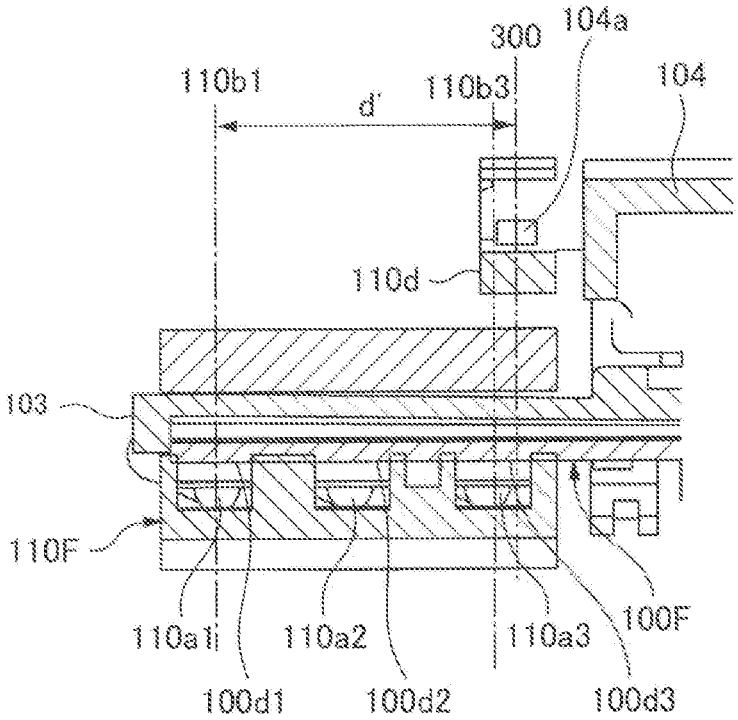
FIG. 8A is a vertical section view showing a connector locking structure of a second comparative example.
Figure 8B:
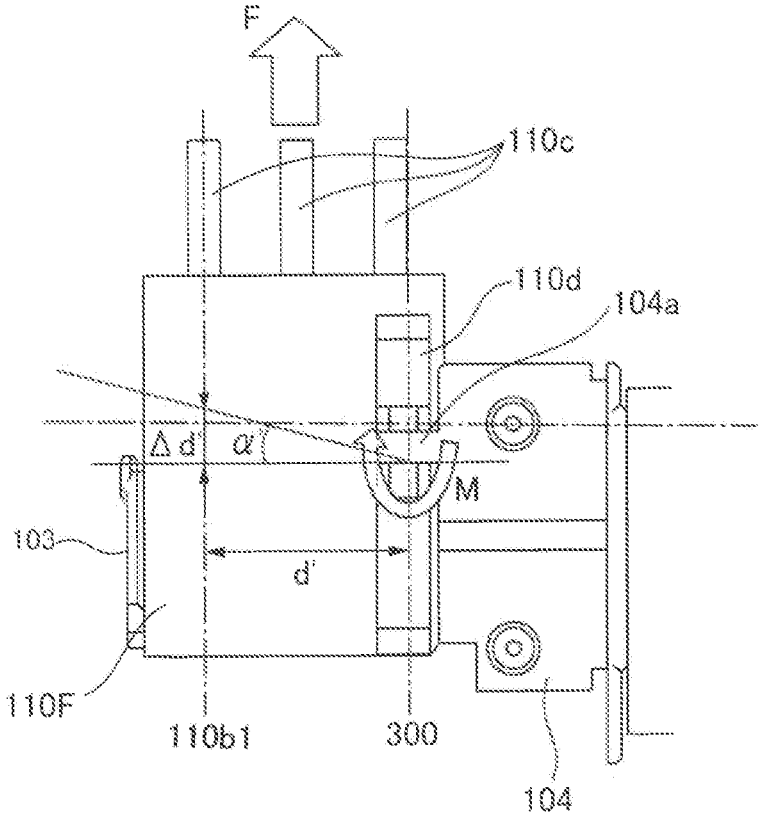
FIG. 8B is a plan view showing the connector locking structure of the second comparative example.
Figure 9:
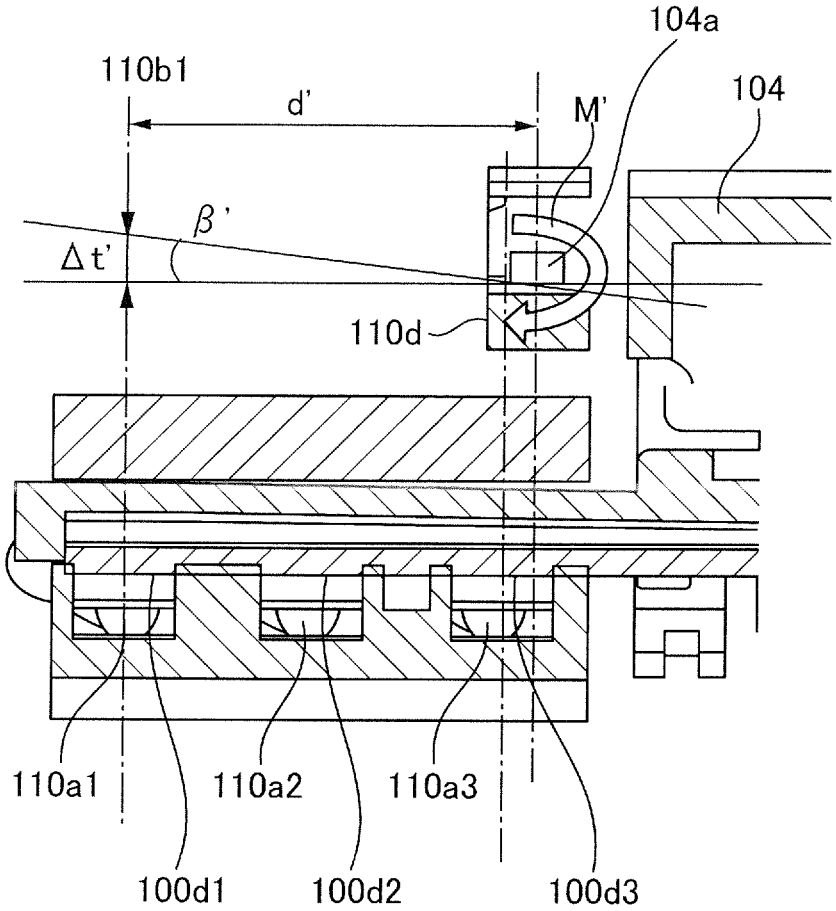
FIG. 9 illustrates deformation when a moment in a vertical plane acts.

FIGS. 8A and 8B illustrate the connector locking structure of a second comparative example, and FIG. 9 illustrates a deformation when a moment in a vertical plane acts. More specifically, FIG. 8A is a vertical section view in parallel with the rotation axial direction of the connector locking structure in an assembled condition, and FIG. 8B is a plan view of the connector locking structure in the assembled condition. FIG. 9 illustrates the moment and a rotational angle in the vertical plane. While structures and sizes of the respective components of the second comparative example are the same with those of the fixing apparatus 40 described above, the ceramic heater 100 will be denoted as a ceramic heater 100F and the connector 110 as a connector 110F in the second comparative example in order to distinguish the second comparative example from the embodiments described later.

The second comparative example is arranged such that fine temperature control can be made by the ceramic heater 100F by increasing a number of resistance heating elements as shown in FIG. 3, so that a number of required electrodes increases more than those of the first comparative example in response to the increase of the resistance heating elements. When the number of electrodes increases, a number of required energizing terminals 110*a* provided on the connector 110F increases correspondingly.

As shown in FIG. 8A, the ceramic heater 100F disposed on the under surface of the guide member 103 has three electrodes 100*d*1, 100*d*2 and 100*d*3 in the second comparative example. The U-shaped connector 110F is attached such that it sandwiches the ceramic heater 100F and the guide member 103 overlapped with each other. Then, the energizing terminals 110*a*1, 110*a*2 and 110*a*3 provided on the connector 110F come into contact with the electrodes 100*d*1, 100*d*2 and 100*d*3 of the ceramic heater 100F, respectively.

As shown in FIG. 8B, the lock portion 110*d* for stopping the connector 110F is disposed on the upper surface of the connector 110F. In the second comparative example, a center line 300 of the lock portion 110*d* is disposed on a side closer to the fixing flange 104 than a center line 110*b*3 of the energizing terminal 110*a*3 located on the side closer to the fixing flange 104 among the energizing terminals 110*a*1, 110*a*2 and 110*a*3 of the connector 110F.

While a distance between the lock portion 110*d* and the energizing terminal 110*a*1 distant most from the lock portion 110*d* is a distance (d) in the first comparative example as shown in FIG. 7A, the distance is a distance (d') in the second comparative example because the energizing terminal 110*a*3 is added as shown in FIG. 8A. Accordingly, if the sizes and pitches of the energizing terminals 110*a*1, 110*a*2 and 110*a*3 are the same in the first and second comparative examples, the following relationship holds:

$$d'>d$$

The fixing belt 101 moves in the vertical direction by a distance (h) during when the condition changes from the pressing condition shown in FIG. 5A to the pressure releasing condition shown in FIG. 5B. In response to that, the wiring line 110*c* connected to the connector 110 pulls the connector 110 obliquely downward. Then, there is a case when a force F in a direction pulling/inserting the connector 110 acts on the connector 110 as shown in FIG. 8B due to a reaction force of elastic deformation of the wiring line 110*c* connected to the energizing terminal 110*a*1 of the connector 110 as shown in FIG. 6. In such a case, a moment M that tries to rotate the connector 110 centering on the lock portion 110*d* acts and rotates the connector 110 by a rotational angle α'.

The rotational angle α' generates a positional shift Δd' of the energizing terminal 110*a*1 with respect to the electrode 100*d*1 in proportional to the distance (d') between the lock portion 110*d* and the energizing terminal 110*a*1 as shown in FIG. 8A, as follows:

$$\Delta d'=d'\alpha'$$

The more the number of energizing terminals of the connector 110, the more the distance (d') between the lock portion 110*d* and the energizing terminal 110*a*1 increases, so that an allowance of the rotational angle α' of the positional shift of the energizing terminal 110*a*1 with respect to the electrode 100*d*1 decreases.

When a force T in a direction vertical to the direction in which the connector 110F is pulled/inserted acts on the wiring line 110*c* connected to the energizing terminal 110*a* as shown in FIG. 6, a moment M' in the vertical plane acts centering on the lock portion 110*d* as shown in FIG. 9. When the connector 110F is driven by the moment M' and rotates by a rotational angle β', there is a possibility that a positional shift (levitation) of Δt' is generated between the electrode 100*d*1 of the ceramic heater 100F and the energizing terminal 110*d*1 of the connector 110F, as follows:

$$\Delta t' = d'\beta'$$

At this time, there is a possibility that the energizing terminal 110*d*1 separates from the electrode 100*d*1 and causes a contact failure. An allowance of the rotational angle β' of the levitation of the energizing terminal 110*a*1 with respect to the electrode 100*d*1 decreases also in this case if the number of energizing terminals 110*a* of the connector 110F is increased because the distance between the lock portion 110*d* and the energizing terminal 110*a*1 increases.

Then, the lock portion 110*d* is moved on a side closer to the end of the ceramic heater 100 than the first and second comparative examples in the following embodiments such that the connector 110 is hard to rotate centering on the lock portion 110*d*. Then, the following connector 110 having a plurality of energizing terminals (three in the following embodiments) is arranged to avoid a contact failure by suppressing any positional shift and insufficient contact pressure between the electrode 100*a*1 of the ceramic heater 100 and the energizing terminals 110*a*1 of the connector 110.

<First Embodiment>

Figure 10A:
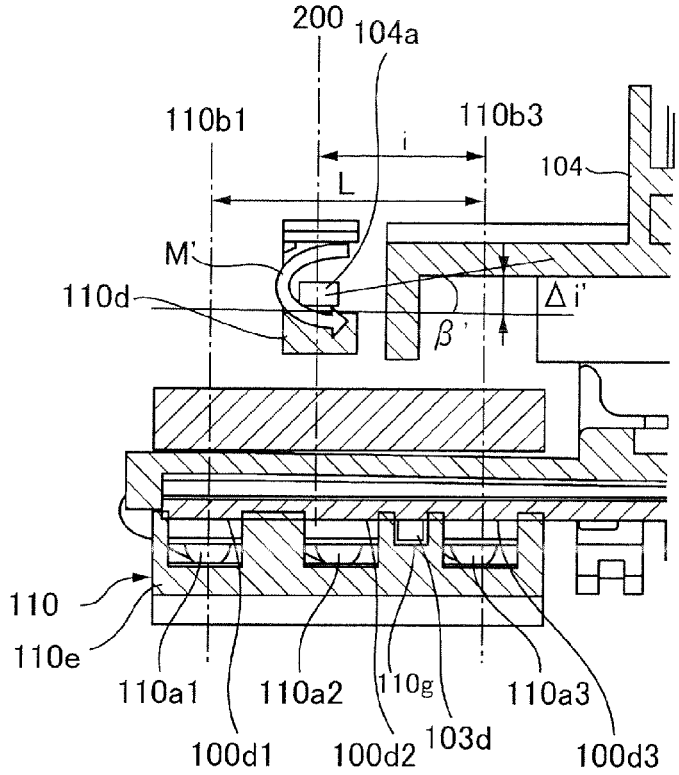
FIG. 10A is a vertical section view showing a connector locking structure of a first embodiment.
Figure 10B:
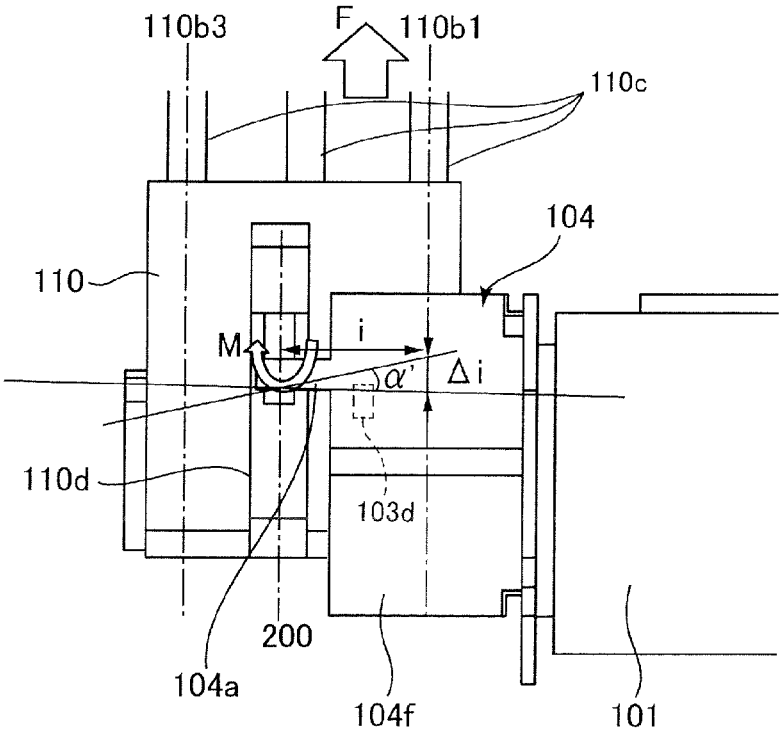
FIG. 10B is a plan view showing the connector locking structure of the first embodiment.

FIGS. 10A and 10B illustrate the connector locking structure of the first embodiment, wherein FIG. 10A is a vertical section view in parallel with the rotation axial direction of the connector locking structure in an assembled condition, and FIG. 10B is a plan view of the connector locking structure in the assembled condition.

As shown in FIG. 6, the connector 110, i.e., one exemplary connector, is provided with the plurality of energizing terminals 110*a* connected respectively with the plurality of electrodes 100*d*. The connector 110 is attached to the fixing belt 101 on the outside of the fixing flange 104 in a direction orthogonal to the longitudinal direction of the ceramic heater 100 so as to sandwich the end of the ceramic heater 100. That is, the U-shaped connector 110 is attached so as to sandwich the ceramic heater 100 and the guide member 103 overlapped with each other. The connector 110 serves also as a lock member that locks the end portions of the ceramic heater 100 and the guide member 103 in a direction of thickness thereof.

The connector 110 is fixed to the end of the ceramic heater 100 while engaging the interlock portion 104*a*, i.e., one example of a first engage portion, provided on the fixing flange 104 with the lock portion 110*d*, i.e., one example of a second engage portion, provided on the connector 110. The lock portion 110*d* is an arm member whose base is fixed to the connector housing (connector body) 110*e* and which moves, in response to an attachment motion of the connector 110, elastically in a direction vertical to a direction in which the connector 110 is attached, and engages with the interlock portion 104*a* of the fixing flange 104. The interlock portion 104*a* engages with the lock portion 110*d* in response to the attachment motion of the connector 110 at position where the connector 110 butts against the guide member 103.

As shown in FIG. 10A, the ceramic heater 100 disposed on the under surface of the guide member 103 has three downward electrodes 100*d*1, 100*d*2, and 100*d*3. The upward energizing terminals 110*a*1, 110*a*2 and 100*a*3 provided on the connector 110 come into contact respectively with the electrodes 100*d*1, 100*d*2, and 100*d*3 of the ceramic heater 100.

The position of the connector 110 with respect to the guide member 103 is defined by guiding a holder interlock portion 103*d* provided as a projection on the under surface of the guide member 103 to a guide groove 110*g* of the connector housing (connector body) 110*e* in the first embodiment. The lock portion 110*d* is provided while being shifted from the holder interlock portion 103*d* within a range of L between center lines 110*b*1 and 110*b*3 of the energizing terminals (first and second end energizing terminals) 110*a*1 and 110*a*3 located at the both ends of the connector 110 in the longitudinal direction of the ceramic heater 100 in the first embodiment. Due to that, a rotatable range of the connector 110 defined by a backlash of the holder interlock portion 103*d* and a backlash of the engagement of the lock portion 110*d* is reduced as compared to a second embodiment described later in which the lock portion 110*d* is disposed near the holder interlock portion 103*d*.

That is, the lock portion 110*d*, i.e., the second engage portion, of the connector 110 engages with the interlock portion 104*a*, i.e., the first engage portion, of the fixing flange 104 such that a center line 200 thereof in a direction in which the electrodes 100*d*1 through 100*d*3 are arrayed, i.e., the rotation axial direction in the present embodiment, is located between the center lines 110*b*1 and 110*b*3 in the array direction of the first and second energizing terminals 110*a*1 and 110*a*3 located at the both ends among the plurality of energizing terminals 110*a*1 through 110*a*3.

More specifically, the engage position of the interlock portion 104*a* with the lock portion 110*d* is disposed in the vicinity of a center position between the first and second energizing terminals in the array direction, i.e., in the rotation axial direction. Even more specifically, the engage position of the interlock portion 104*a* and the lock portion 110*d* is disposed on a side distant in the rotation axial direction from the fixing flange body 104*f* more than the center position between the first and second end energizing terminals.

Due to that, a distance from the center of the energizing terminal 110*a*3 distant most from the lock portion 110*d* to the center of the lock portion 110*d* is a distance (i) in the first embodiment.

When a force F in a direction in which the connector 110 is pulled/inserted acts as shown in FIG. 10B due to a reaction force of elastic deformation of the wiring lines 110*c* and to the pressing and pressure-releasing motions of the fixing apparatus 40, a moment M acts within a horizontal plane centering on the lock portion 110*d*. When a rotational angle of the connector 110 is assumed to be an angle α' in this case, a positional shift Δi of the energizing terminal 110*a*1 of the connector 110 with respect to the electrode 100*d*1 of the ceramic heater 100 is expressed as follows:

$$\Delta i = i \times \alpha'$$

The following relationship holds between the second comparative example and the first embodiment:

$$d > i$$

Therefore, the following relationship holds between the positional shift Δd in the second comparative example and the positional shift Δi in the first embodiment:

$$\Delta d > \Delta i$$

Accordingly, an allowance of the angle α' to the positional shift of the energizing terminal 110*a* of the connector 110 with respect to the electrode 100*d*1 of the ceramic heater 100 increases in the first embodiment more than that in the second comparative example. That is, the connector 110 is hard to rotate more than the second comparative example in which the lock portion 110*d* is provided on the side closer to the fixing flange 104 than the energizing terminal 110*a*1.

When a force T acts in a direction vertical to the direction in which the connector 110 is inserted/pulled as shown in FIG. 6, a moment M' within a vertical plane that tries to rotate the connector 110 centering on the lock portion 110*d* acts as shown in FIG. 10A. When a rotational angle of the connector 110 in this case is assumed to be an angle β', a positional shift Δi' of the energizing terminal 110*a*1 of the connector 110 with respect to the electrode 100*d*1 of the ceramic heater 100 is expressed as follows:

$$\Delta i' = i \times \beta'$$

The following relationship holds between the positional shift ΔT in the first comparative example and the positional shift Δi in the first embodiment from the relationship of d>i described above:

$$\Delta T > \Delta i'$$

Accordingly, an allowance of the angle β' to the positional shift of the energizing terminal 110*a* of the connector 110 with respect to the electrode 100*d* of the ceramic heater 100 increases in the first embodiment more than that in the second comparative example. That is, the connector 110 is hard to rotate more than the second comparative example in which the lock portion 110*d* is provided on the side closer to the fixing flange 104 than the energizing terminal 110*a*1.

The fixing flange 104 is configured such that the fixing flange body 104*f* extends in the rotation axial direction like a peak to a position adjacent the engage position while covering the connector 110 and the interlock portion 104*a* is formed as the projection projecting like a cantilever beam from the fixing flange body (support member body) 104*f* to the outside of the rotation axial direction. Therefore, strength and rigidity increase even if the interlock portion 104*a* is thinly formed. The peak part of the fixing flange body 104*f* also reduces chances of the connector 110 colliding against another member and shifting the contact point or applying a load.

<Second Embodiment>

Figure 11A:
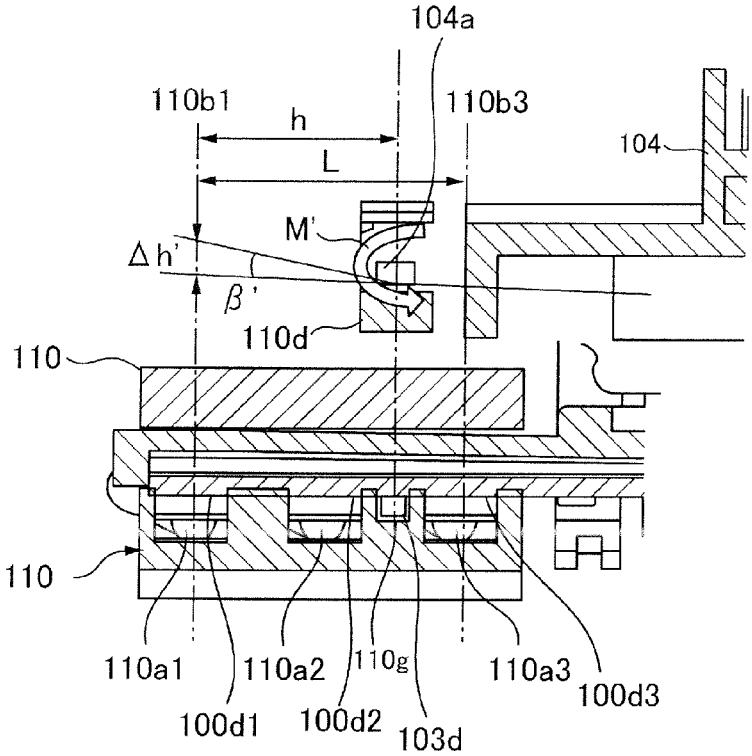
FIG. 11A is a vertical section view showing a connector locking structure of a second embodiment.
Figure 11B:
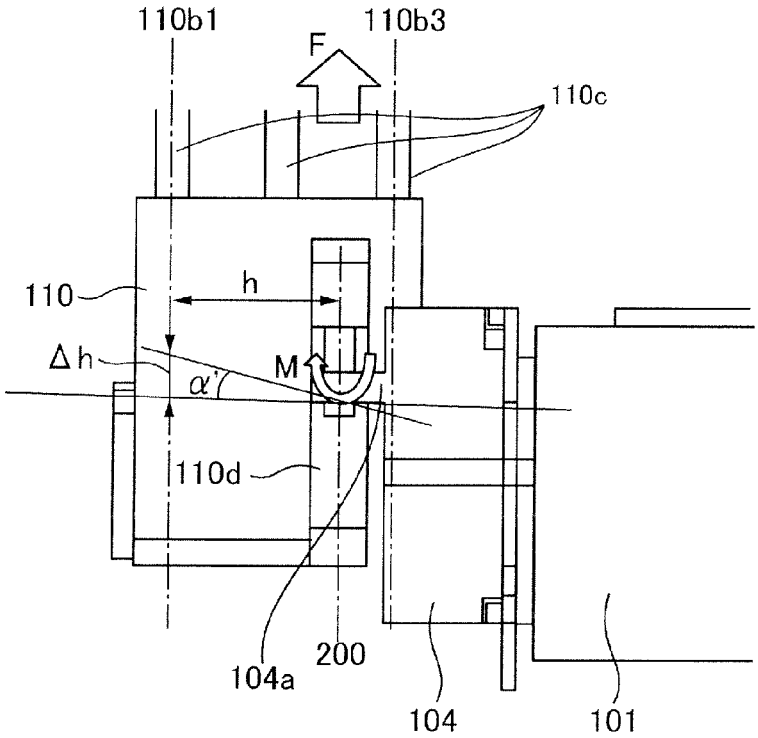
FIG. 11B is a plan view showing the connector locking structure of the second embodiment.

FIGS. 11A and 11B illustrate a connector locking structure of a second embodiment, wherein FIG. 11A is a vertical section view in parallel with the rotation axial direction of the connector locking structure in the assembled condition, and FIG. 11B is a plan view of the connector locking structure in the assembled condition. The second embodiment is configured in the same manner with the first embodiment except position of the lock portion 110*d* of the connector 110. Therefore, the same or corresponding members and parts with those of FIGS. 10A and 10B will be denoted by the same reference numerals and an overlapped explanation thereof will be omitted here.

As shown in FIGS. 11A and 11B, an engage position of the interlock portion 104*a* of the fixing flange 104 with the lock portion 110*d* of the connector 110 is disposed between the energizing terminals 110*a*1 and 110*a*3 on the both ends in the second embodiment. Due to that, a moment that is caused by a force of the wiring line 110*c* pushing/pulling the connector 110 and that tries to rotate the connector 110 centering on the engage position of the interlock portion 104*a* with the lock portion 110*d* is smaller than the moment of the second comparative example shown in FIG. 8B.

The U-shaped connector 110 is attached such that it sandwiches the ceramic heater 100 and the guide member 103 overlapped with each other as shown in FIG. 6 in the second embodiment. As shown in FIG. 11A, the ceramic heater 100 disposed on the under surface of the guide member 103 includes the three downward electrodes 100*d*1, 100*d*2 and 100*d*3. The upward energizing terminals 110*a*1, 110*a*2 and 110*a*3 provided on the connector 110 come into contact with the electrodes 100*d*1, 100*d*2 and 100*d*3 of the ceramic heater 100, respectively.

In the second embodiment, the lock portion 110*d* is provided at a position overlapping with the holder interlock portion 103*d* within a range L, i.e., between the center lines of the respective energizing terminals 110*a*1 and 110*a*3 located at the both ends of the connector 110 in the longitudinal direction of the ceramic heater 100. Therefore, a distance from the center of the energizing terminal 110*a*1 distant most from the lock portion 110*d* to the center of the lock portion 110*d* is a distance (h) in the second embodiment. That is, the distance between the lock portion 110*d* and the energizing terminal 110*d*1 distant most from the lock portion 110*d* is the distance (h).

Although the lock portion 110*d* and the holder interlock portion 103*d* are shifted from each other in the first embodiment, the lock portion 110*d* and the holder interlock portion 103*d* are aligned in the second embodiment.

When a force F in the direction in which the connector 110 is pulled/inserted acts due to a reaction force of elastic deformation of the wiring lines 110*c* or to the pressing and pressure-releasing motions of the fixing apparatus 40, a moment M acts within a horizontal plane centering on the lock portion 110*d* as shown in FIG. 11B. When a rotational angle of the connector 110 is assumed to be an angle α' in this case, a positional shift Δh of the energizing terminal 110*a*1 of the connector 110 with respect to the electrode 100*d*1 of the ceramic heater 100 is expressed as follows:

$$\Delta h = h \times \alpha'$$

The following relationship holds between the second comparative example and the second embodiment:

$$d > h$$

Therefore, the following relationship holds between the positional shift Δd in the second comparative example and the positional shift Δh in the second embodiment:

$$\Delta d > \Delta h$$

Accordingly, an allowance of the angle α' to the positional shift of the energizing terminal 110*a* of the connector 110 with respect to the electrode 100*d*1 of the ceramic heater 100 increases in the second embodiment more than that in the second comparative example. That is, the connector 110 is hard to rotate more than the second comparative example in which the lock portion 110*d* is provided on the side closer to the fixing flange 104 than the energizing terminal 110*a*1.

When the force T acts in the direction vertical to the direction in which the connector 110 is inserted/pulled as shown in FIG. 6, a moment M' within the vertical plane that tries to rotate the connector 110 centering on the lock portion 110*d* acts as shown in FIG. 11A. When a rotational angle of the connector 110 in this case is assumed to be an angle β', a positional shift Δh' of the energizing terminal 110*a*1 of the connector 110 with respect to the electrode 100*d*1 of the ceramic heater 100 is expressed as follows:

$$\Delta h' = h \times \beta'$$

The following relationship holds between the positional shift ΔT in the first comparative example and the positional shift Δh in the second embodiment from the relationship of d>h described above:

$$\Delta T > \Delta h'$$

Accordingly, an allowance of the angle β' to the positional shift of the energizing terminal 110*a* of the connector 110 with respect to the electrode 100*d* of the ceramic heater 100 increases in the second embodiment more than that in the second comparative example. That is, the connector 110 is hard to rotate more than the second comparative example in which the lock portion 110*d* is provided on the side closer to the fixing flange 104 than the energizing terminal 110*a*1.

Next, in terms of the connector locking structures of the first and second comparative examples and the first and second embodiments, an inspection was made on an occurrence of the positional shift between the electrode 100*d* of the ceramic heater 100 (100E, 100F) and the energizing terminal 110*a* of the connector 110 (110E, 110F). That is, the fixing apparatus 40 was built by using the connector locking structures of the first and second comparative examples and the first and second embodiments, and the pressure mechanism 130 was put into operation successively to generate loads on the connector 110 (110E, 110F). The electrode 100*d* of the ceramic heater 100 (100E, 100F) was observed by a microscope to confirm whether or not there exists scratches caused by the positional shift by repeating the pressing and pressure-releasing motions of the pressure mechanism 130 by 10,000 times, 100,000 times and 500,000 times as shown in Table 1 below.

TABLE 1

| NUMBER OF TIMES OF APPLICATION OF LOAD | FIRST COMPARATIVE EXAMPLE | SECOND COMPARATIVE EXAMPLE | FIRST EMBODIMENT |
|---|---|---|---|
| 10000 | None | Slight | None |
| 100000 | None | Exist | None |
| 500000 | None | Exist | None |

As shown in Table 1, practically favorable results could have been obtained in the first comparative example and first and second embodiments. A large number of scratches were confirmed to have been generated on the contact point of the electrode 100*d* and the energizing terminal 110*a* in the second comparative example.

Accordingly, the first and second embodiments make it possible to reduce the possibility of a contact failure otherwise caused by the positional shift of the contact point of the electrodes with the energizing terminals and by insufficient contact pressure as compared to the second comparative example in the connector including three or more energizing terminals.

<Third Embodiment>

The present invention may be carried out by another embodiment in which a part or a whole of the configuration of the embodiments described above is replaced with their substitute configuration as long as the stopper of the connector attached to the end of the heater substrate that heats the recording medium through the belt member is disposed inside of the wiring lines on the both ends. For instance, the invention may be configured such that the electrodes are arrayed in the intersection direction and the connector is attached in the rotation axial direction. Still further, even if the connector attaching direction and the electrode array direction are the same such that the electrodes are arrayed in the rotation axial direction and the connector is also attached in the rotation axial direction, the invention is applicable if a force acts on the connector in the direction intersecting with the direction in which the electrodes are arrayed.

The number of energizing terminals 110*a* provided on the connector 110 is not limited to be three, and four or more energizing terminals may be disposed on the connector 110. The belt member is not also limited to be the fixing belt 101. The recording medium P may be a transfer sheet, an electrofax sheet, an electrostatic recording sheet, an OHP sheet, a printing sheet, or a format sheet. The image heating apparatus includes, beside the fixing apparatus, a surface heating apparatus configured to adjust glossiness and nature of a surface of a semi-fixed or fixed image. The image heating apparatus also includes a curl removing apparatus configured to remove a curl of a recording medium on which a fixed image has been formed. The image heating apparatus may be also carried out as one system or a component unit solely installed and controlled, beside being incorporated into an image forming apparatus. That is, the image heating apparatus may be carried out in any image forming apparatus regardless of types such as monochrome/full-color, sheet-type/recording medium conveying-type, intermediate transfer-type, toner image forming-type, and transfer-type. The invention may be carried out in any image forming apparatus of various uses such as a printer, various printing machines, a copier, a facsimile machine, a multi-function printer, or the like, by adding a required device, equipments, and a casing structure.

While the present invention has been described with reference to the exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-229908, filed on Oct. 17, 2012, which is hereby incorporated by reference herein in its entirety.

What is claimed is:

1. An image heating apparatus, comprising:

a belt member configured to heat an image on a recording medium;

a support member configured to rotatably support a longitudinal end of the belt member and to include a first engage portion;

a heating member including a plurality of electrodes arrayed at an longitudinal end thereof and configured to heat the belt member by being energized through the plurality of electrodes; and a connector including:

a plurality of energizing terminals connected respectively to the plurality of electrodes and attached to the longitudinal end of the heating member; and a second engage portion that engages with the first engage portion to lock the connector and the heating member, the second engage portion engaging with the first engage portion such that a center, in an array direction in which the electrodes are arrayed, of the second engage portion is located between centers, in the array direction in which the electrodes are arrayed, of first and second end energizing terminals located at both ends among the plurality of energizing terminals, wherein an engage position where the first engage portion engages with the second engage portion is disposed between the first and second end energizing terminals in the array direction in which the electrodes are arrayed, wherein the array direction is also a longitudinal direction of the belt member, and wherein the engage position of the first and second engage portions is disposed, in the longitudinal direction of the belt member, farther from a support member body than the center position between the first and second end energizing terminals.

2. The image heating apparatus according to claim 1, wherein the connector is attached so as to sandwich the longitudinal end of the heating member in an intersection direction intersecting with the longitudinal direction and includes a wiring line extending in the intersection direction.

3. The image heating apparatus according to claim 2, further comprising a guide member configured to support the heating member and to guide rotation of the belt member, wherein the connector locks ends of the heating member and the guide member in a direction of thickness thereof.

4. An image heating apparatus, comprising:

a belt member configured to heat an image on a recording medium;

a support member configured to rotatable support a longitudinal end of the belt member and to include a first engage portion;

a heating member including a plurality of electrodes arrayed at an longitudinal end thereof and configured to heat the belt member by being energized through the plurality of electrodes; and a connector including:

a plurality of energizing terminals connected respectively to the plurality of electrodes and attached to the longitudinal end of the heating member; and a second engage portion that engages with the first engage portion to lock the connector and the heating member, the second engage portion engaging with the first engage portion such that a center, in an array direction in which the electrodes are arrayed, of the second engage portion is located between centers, in the array direction in which the electrodes are arrayed, of first and second end energizing terminals located at both ends among the plurality of energizing terminals, wherein the array direction is also a longitudinal direction of the belt member, and wherein the connector is attached so as to sandwich the longitudinal end of the heating member in an intersection direction intersecting with the longitudinal direction and includes a wiring line extending in the intersection direction.

5. An image heating apparatus, comprising:

a belt member configured to heat an image on a recording medium;

a support member configured to rotatably support a longitudinal end of the belt member and to include a first engage portion;

a heating member including a plurality of electrodes arrayed at an longitudinal end thereof and configured to heat the belt member by being energized through the plurality of electrodes; and a connector including:

a plurality of energizing terminals connected respectively to the plurality of electrodes and attached to the longitudinal end of the heating member; and a second engage portion that engages with the first engage portion to lock the connector and the heating member, the second engage portion engaging with the first engage portion such that a center, in an array direction in which the electrodes are arrayed, of the second engage portion is located between centers, in the array direction in which the electrodes are arrayed, of first and second end energizing terminals located at both ends among the plurality of energizing terminals, wherein the second engage portion is an arm member whose base is fixed to a connector body and, in response to an attachment motion of the connector, engages with the first engage portion by moving elastically in a direction vertical to an attachment direction in which the connector is attached, and wherein the first engage portion is a project portion provided from a support member body so as to project in a manner of a cantilever beam toward an outside in a longitudinal direction of the belt member.

6. An image heating apparatus, comprising:

a belt member configured to heat an image on a recording medium;

a support member configured to rotatably support a longitudinal end of the belt member and to include a first engage portion;

a heating member including a plurality of electrodes arrayed at an longitudinal end thereof and configured to heat the belt member by being energized through the plurality of electrodes;

a guide member configured to support the heating member and to guide rotation of the belt member; and a connector including:

a plurality of energizing terminals connected respectively to the plurality of electrodes and attached to the longitudinal end of the heating member; and a second engage portion that engages with the first engage portion to lock the connector and the heating member, the second engage portion engaging with the first engage portion such that a center, in an array direction in which the electrodes are arrayed, of the second engage portion is located between centers, in the array direction in which the electrodes are arrayed, of first and second end energizing terminals located at both ends among the plurality of energizing terminals, wherein the connector locks ends of the heating member and the guide member in a direction of thickness thereof.

7. The image heating apparatus according to claim 6, wherein the guide member includes a projection;

the connector has a connector body including a guide groove that engages with the projection of the guide member and defines a position of the connector; and the engage position of the first and second engage portions is shifted from a position where the projection engages with the guide groove.

8. The image heating apparatus according to claim 6, wherein the first and second engage portions engage at a position where the connector abuts against the guide member in response to the attachment motion of the connector.

9. An image heating apparatus, comprising:

a belt member configured to heat an image on a recording medium;

a support member configured to rotatable support a longitudinal end of the belt member and to include a first engage portion;

a heating member including a plurality of electrodes arrayed at an longitudinal end thereof and configured to heat the belt member by being energized through the plurality of electrodes;

a pressure contact roller configured to come into pressure contact with the heating member through an intermediary of the belt member and to form a nip portion with the belt member;

a pressure mechanism configured to press the support member toward the pressure contact roller such that a pressure at the nip portion is variable; and a connector including:

a plurality of energizing terminals connected respectively to the plurality of electrodes and attached to the longitudinal end of the heating member; and a second engage portion that engages with the first engage portion to lock the connector and the heating member, the second engage portion engaging with the first engage portion such that a center, in an array direction in which the electrodes are arrayed, of the second engage portion is located between centers, in the array direction in which the electrodes are arrayed, of first and second end energizing terminals located at both ends among the plurality of energizing terminals, wherein an engage position where the first engage portion engages with the second engage portion is disposed between the first and second end energizing terminals in the array direction in which the electrodes are arrayed, wherein the array direction is also a longitudinal direction of the belt member, and wherein the engage position of the first and second engage portions is disposed, in the longitudinal direction of the belt member, farther from a support member body than the center position between the first and second end energizing terminals.

* * * * *